United States Patent [19]

Inoue

[11] 4,226,053

[45] Oct. 7, 1980

[54] GRINDING APPARATUS

[75] Inventor: Kiyoshi Inoue, Tokyo, Japan

[73] Assignee: Inoue-Japax Research Incorporated, Yokohama, Japan

[21] Appl. No.: 903,062

[22] Filed: May 5, 1978

[30] Foreign Application Priority Data

May 10, 1977 [JP] Japan ..... 52-53405

[51] Int. Cl.[3] ..... B24B 49/00

[52] U.S. Cl. ..... 51/165.77; 51/72 L; 51/165.8; 51/166 T

[58] Field of Search ..... 125/11 R; 51/72 R, 3 R, 51/72 L, 165 R, 165.71, 165.72, 165 TP, 165.77, 165.8, 166 T

[56] References Cited

U.S. PATENT DOCUMENTS

| | | | |
|---|---|---|---|
| Re. 28,766 | 4/1976 | Villano | 51/165 TP |
| 2,248,143 | 7/1941 | Weber | 51/3 X |
| 2,298,496 | 10/1942 | Metzger | 51/3 X |
| 2,420,504 | 5/1947 | Stewart | 51/3 |
| 3,019,562 | 2/1962 | Price | 51/3 |

FOREIGN PATENT DOCUMENTS

| | | | |
|---|---|---|---|
| 2623812 | 12/1977 | Fed. Rep. of Germany | 51/3 |

*Primary Examiner*—Harold D. Whitehead
*Attorney, Agent, or Firm*—Karl F. Ross

[57] ABSTRACT

A grinding apparatus and method in which at least two grinding wheels are coaxially and rotatably supported on a common spindle and are juxtaposed with a worktable for a workpiece. A pulse motor on either the worktable or the spindle displaces the wheels and the workpiece relatively along a Z-axis orthogonal to the spindle axis and another pulse motor effects relative displacement of the wheels and worktable along an X-axis which is normal to the Z-axis and is codirectional with the spindle axis. Yet another motor serves to relatively displace the wheels and worktable along a Y-axis which is normal both to the Z-axis and to the X-axis while a numerical controller applies control-signal pulses to the Z-axis displacement and the X-axis displacement motors.

6 Claims, 2 Drawing Figures

GRINDING APPARATUS

FIELD OF THE INVENTION

The present invention relates to an improvement in grinding apparatus for mechanically or electrochemically machining workpieces with grinding wheels.

BACKGROUND OF THE INVENTION

In the conventional grinding art, it has been common practice to use a plurality of grinding wheels of different configurations and/or sizes to machine individual portions of a workpiece in rough and finish machining steps. As a result, the machining operation has been inconvenient, required a high degree of skillness and been difficult to achieve satisfactory machining accuracy.

SUMMARY OF THE INVENTION

In view of these problems, the present invention provides an improved apparatus in which use is made of at least two grinding wheels that are different in configuration and/or size from one another. Such wheels may be curved or rectilinear in cross section, or a rough-machining and finish machining wheels having a similar shape supported spacedly from one another on a single rotary spindle, the spacing between the wheels being adjustable. A workpiece is mounted on a work table and in juxtaposition with these grinding wheels. The machining feed is effected with means coupled with the work table or the spindle to produce displacement along the Z-axis, means for producing displacement the X-axis which is normal to the Z-axis and coaxially or in parallel with the spindle and means for producing displacement along the Y-axis which is normal to both the Z-axis and the X-axis. Control is effected for at least the Z-axis and X-axis displacement means with signals fed in accordance with numerical control or copying technique the displacement being preferably effected digitally at a feed rate of 1 to 5 microns per pulse. The Y-axis displacement is effected either under digital or analog control to maintain the rate of rotation of the grinding wheel substantially constant. The distance between the wheels supported on the spindle should be adjustable as desired and memorized (recorded) in the means for providing numerical or copying signals so that the wheels may be succesively or alternately used to achieve a desired mode of grinding including roughing to finishing machining.

BRIEF DESCRIPTION OF THE DRAWING

The invention will now be described with reference to the accompanying drawing in which.

SPECIFIC DESCRIPTION

Figure 1:
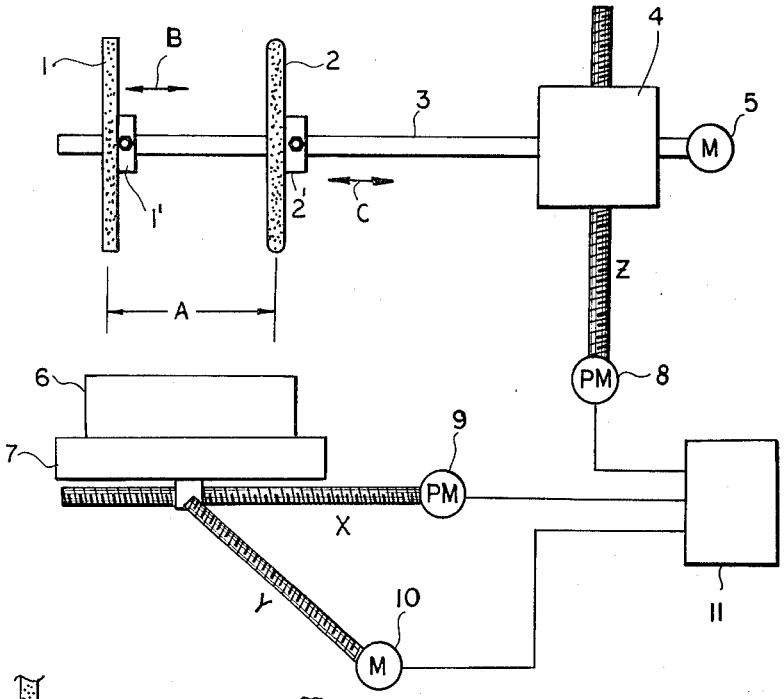
FIG. 1 is a diagram which illustrates an embodiment of the invention.

Flat and curved grinding wheels 1 and 2, respectively, are used in which the wheel 2 is essential for use and the wheel 1 and a further wheel or wheels which may be additionally provided can take a form as desired. Each wheel is disk-shaped with the periphery adapted to perform grinding as desired while being rotated. The wheels 1 and 2 are mounted upon a spindle 3 and with a spacing A therebetween adjusted in accordance with the size of a workpiece 6 supported upon a work table 7 and the configuration of grinding desired. The spindle 3 is rotatably held on a bearing 4 and driven by a motor 5 for a predetermined pattern of the displacement thereof. The bearing support 4 is driven by a motor 8 coupled therewith for displacement along the Z-axis which extends in parallel with the direction in which the wheels 1 and 2 and the workpiece 6 are juxtaposed and machining is performed. Further, a motor 9 is provided for driving the work table 7 along the X-axis normal to the Z-axis and in parallel with the axial direction of the spindle 3. A further motor 10 drives the work table 7 along the Y-axis which is normal both to the Z-axis and the X-axis. A numerical controller 11 is provided for applying drive signals to each of the motors 8, 9 and 10, respectively. Leadscrews are diagrammatically shown to provide the coupling between the pulse motors 8-10 and the driven members.

In grinding operation, the grinding wheels 1 and 2 rotated by the motor 5 are juxtaposed with the workpiece 6 and machining feed thereof is effected in the direction of the Z-axis by the motor 8. This displacement requires a precision control for desired machining results and accordingly a digital feed of the order of 1 to 5 microns per pulse is effected. Displacement along the X-axis is effected by the motor 9 here again preferably with a precision digital feed of the order of 1 to 5 microns per pulse. Overtravel is thereby advantageously prevented. The positioning control along the Y-axis by the motor 10 effectuates a contact of the wheel 1 or 2 with the workpiece 6 for grinding operation. An angular grinding is effected with the wheel 1 set in juxtaposition with the portion of the workpiece 6 to be machined through the X-axis displacement with the numerical controller 11 delivering signals respectively for X-axis and Z-axis displacement feeds as well as the Y-axis displacement feed for grinding. Grinding of a round or curved portion is effected with the wheel 2 set in juxtaposition with the portion of the workpiece 6 to be machined through the X-axis displacement feed under control of the numerical controller 11. By selectively using the wheel 1 to 2 or 2 to 1 in sequence or repeated alternation in accordance with the configuration of the workpiece portion, an entire grinding operation is performed. By presetting the distance A between the wheels 1 and 2 (adjustable via mounts 1', 2' in the direction of arrows R and C) in the numerical controller 11, the positioning control of the wheels from the preceding position to the subsequent position of the wheel to be selected can readily be made by the numerical controller 11 through the X-axis displacement feed with the motor 9, the machining feed along the Z-axis and the Y-axis displacement feed automatically in sequence with precision digital feed control, thereby enabling precision grinding.

The Y-axis displacement feed by the motor 10 is effected so as to maintain the rotation rate of the wheel constant so that a stabilized grinding operation is attained. The Y-axis displacement may either be of the analog or digital type. The drive motor 10 may thus be a DC motor, hydraulic, pneumatic cylinder system.

Figure 2:
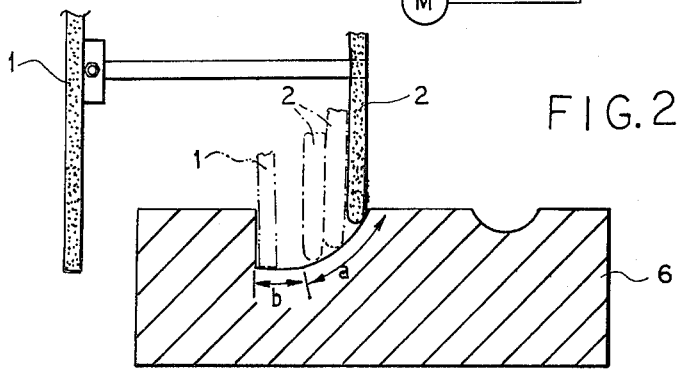
FIG. 2 is a diagrammatic section showing certain modes of grinding to be conducted in accordance with the invention.

FIG. 2 shows a mode of grinding operation in which a V-shaped groove is imparted to a workpiece 6. The round wheel 2 is used for grinding the round portion a and the wheel 1 for the angular portion b in the same workpiece as described in the foregoing. pg,7

I claim:

1. A grinding apparatus comprising:

at least two grinding wheels coaxially and rotatably supported on a common spindle including a first, rough-grinding wheel and a second, finish-grinding wheel having a different texture from that of the first wheel;

a worktable for mounting a workpiece in juxtaposition with said wheels;

means provided on one of said worktable and said spindle for displacing said wheels and said workpiece relatively along a Z-axis orthogonal to the spindle axis;

means for effecting relative displacement of the wheels and worktable along an X-axis which is normal to said Z-axis and is codirectional with said spindle axis;

means for effecting relative displacement of the wheels and worktable along a Y-axis which is normal to both said Z-axis and to said X-axis; and means for applying control-signal pulses to at least said Z-axis displacement means and said X-axis displacement means for stepping the relative displacement along the respective axes, the distance between said wheels being adjustable and said distance being memorized in said means for applying control signals, each of the displacements along the Z-axis and X-axis is effected with an increment of displacement of 1 to 5 microns per pulse.

2. A grinding apparatus comprising:

at least two grinding wheels different from one another in roughness coaxially and rotatably supported on a common spindle;

a worktable for mounting a workpiece in juxtaposition with said wheels;

means provided on one of said worktables and said spindle for displacing said wheels and said workpiece relatively along a Z-axis orthogonal to the spindle axis;

means for effecting relative displacement of the wheels and worktable along an X-axis which is normal to said Z-axis and is codirectional with said spindle axis;

means for effecting relative displacement of the wheels and worktable along a Y-axis which is normal both to said Z-axis and to said X-axis; and means for applying control-signal pulses to at least said Z-axis displacement means and said X-axis displacement means for stepping the relative displacement along the respective axes, the distance between said wheels being adjustable and said distance being memorized in said means for applying control signals, each of the displacements along the Z-axis and X-axis is effected with an increment of displacement of 1 to 5 microns per pulse.

3. A grinding apparatus comprising:

at least two differently sized grinding wheels coaxially and rotatably supported on a common spindle;

a worktable for mounting a workpiece in juxtaposition with said wheels;

means provided on one of said worktable and said spindle for displacing said wheels and said workpiece relatively along a Z-axis orthogonal to the spindle axis;

means for effecting relative displacement of the wheels and worktable along an X-axis which is normal to said Z-axis and is codirectional with said spindle axis;

means for effecting relative displacement of the wheels and worktable along a Y-axis which is normal to both said Z-axis and to said X-axis; and means for applying control-signal pulses to at least said Z-axis displacement means and said X-axis displacement means for stepping the relative displacement along the respective axes, the distance between said wheels being adjustable and said distance being memorized in said means for applying control signals, each of the displacements along the Z-axis and X-axis is effected with an increment of displacement of 1 to 5 microns per pulse.

4. A grinding apparatus comprising:

at least two grinding wheels of different configurations coaxially and rotatably supported on a common spindle;

a worktable for mounting a workpiece in juxtaposition with said wheels;

means provided on one of said worktable and said spindle for displacing said wheels and said workpiece relatively along a Z-axis orthogonal to the spindle axis;

means for effecting relative displacement of the wheels and worktable along an X-axis which is normal to said Z-axis and is codirectional with said spindle axis;

means for effecting relative displacement of the wheels and worktable along a Y-axis which is normal to both said Z-axis and to said X-axis; and means for applying control-signal pulses to at least said Z-axis displacement means and said X-axis displacement means for stepping the relative displacement along the respective axes, the distance between said wheels being adjustable and said distance being memorized in said means for applying control signals, each of the displacements along the Z-axis and X-axis is effected with an increment of displacement of 1 to 5 microns per pulse.

5. A grinding apparatus comprising:

at least two grinding wheels coaxially and rotatably supported on a common spindle;

a worktable for mounting a workpiece in juxtaposition with said wheels;

means provided on one of said worktable and said spindle for displacing said wheels and said workpiece relatively along a Z-axis orthogonal to the spindle axis;

means for effecting displacement of the wheels and worktable along an X-axis which is normal to said Z-axis and is codirectional with said spindle axis;

means for effecting relative displacement of the wheels and worktable along a Y-axis which is normal to both said Z-axis and to said X-axis; and means for applying control-signal pulses to at least said Z-axis displacement means and said X-axis displacement means for stepping the relative displacement along the respective axes, said wheels including a first wheel having a curved peripheral cross section and a second wheel having an angular peripheral cross section, the distance between said wheels being adjustable and said distance being memorized in said means for applying control signals, each of the displacements along the Z-axis and X-axis is effected with an increment of displacement of 1 to 5 microns per pulse.

6. The apparatus defined in claim 1, claim 2, claim 3, claim 4 or claim 5 wherein the rates of rotation of said wheels are held substantially constant.

* * * * *